US005805967A

United States Patent [19]

De Bock et al.

[11] Patent Number: 5,805,967

[45] Date of Patent: Sep. 8, 1998

[54] SINGLE-PASS, MULTI-COLOR ELECTROSTATOGRAPHIC PRINTER WITH INTERMEDIATE TRANSFER MEMBER

[75] Inventors: Jan Julien Irma De Bock, Beveren; Etienne Marie De Cock, Edegen; Daniel Frans Maria Van De Velde, Kontich, all of Belgium

[73] Assignee: Xeikon N.V., Mortsel, Belgium

[21] Appl. No.: 756,117

[22] Filed: Nov. 25, 1996

Related U.S. Application Data

[60] Provisional application No. 60/022,848 Jul. 31, 1996.

[30] Foreign Application Priority Data

Nov. 24, 1995 [EP] European Pat. Off. ..... 95308508

[51] Int. Cl.[6] ..... G03G 15/01; G03G 15/16; G03G 15/20

[52] U.S. Cl. ..... 399/299.1; 399/302; 399/306; 399/307

[58] Field of Search ..... 399/298, 299, 399/302, 303, 306–309

[56] References Cited

U.S. PATENT DOCUMENTS

| | | | |
|---|---|---|---|
| 4,453,820 | 6/1984 | Suzuki | 399/308 |
| 4,657,373 | 4/1987 | Winthaegen et al. | 399/308 |
| 4,796,048 | 1/1989 | Bean | 399/249 |
| 4,992,833 | 2/1991 | Derimiggio | 399/308 |
| 5,059,990 | 10/1991 | Abreu et al. | 346/153 |
| 5,119,140 | 6/1992 | Berkes et al. | 399/390 |
| 5,153,656 | 10/1992 | Johnson et al. | 399/303 |
| 5,351,114 | 9/1994 | Matsuno | 399/307 |
| 5,455,668 | 10/1995 | De Bock et al. | 399/299 |
| 5,585,904 | 12/1996 | Yamamoto et al. | 399/307 |

FOREIGN PATENT DOCUMENTS

| | | |
|---|---|---|
| 0220663 | 5/1987 | European Pat. Off. . |
| 0399794 | 11/1990 | European Pat. Off. . |
| 0601235 | 6/1994 | European Pat. Off. . |
| 0628883 | 12/1994 | European Pat. Off. . |
| 0629927 | 12/1994 | European Pat. Off. . |
| 57-000673 | 1/1982 | Japan . |
| 57-010174 | 1/1982 | Japan . |
| 57-022273 | 2/1982 | Japan . |
| 2040226 | 8/1980 | United Kingdom . |
| 2180948 | 4/1987 | United Kingdom . |
| 9100548 | 1/1991 | WIPO . |
| 9210793 | 6/1992 | WIPO . |
| 9308511 | 4/1993 | WIPO . |
| 9427191 | 11/1994 | WIPO . |
| 9427192 | 11/1994 | WIPO . |
| 9429770 | 12/1994 | WIPO . |

OTHER PUBLICATIONS

European Search Report.

*Primary Examiner*—William J. Royer
*Attorney, Agent, or Firm*—Baker & Botts, L.L.P.

[57] ABSTRACT

A single-pass, multi-color electrostatographic printer has a transfer member which is driven along a continuous path. Toner images of different colors are simultaneously electrostatically deposited in powder form in register with each other on the transfer member to form a multiple toner image. The substrate is fed into contact with the transfer member for transfer of the multiple toner image to at least one face of the substrate. The printer includes a heater for the multiple toner image on the transfer member in advance of the transfer of the image to the substrate, and cooling capability for the transfer member following the transfer of the multiple toner image to the substrate, to a temperature below the glass transition temperature $T_g$ of the toner, prior to deposition of further toner images on the transfer member.

8 Claims, 12 Drawing Sheets

SINGLE-PASS, MULTI-COLOR ELECTROSTATOGRAPHIC PRINTER WITH INTERMEDIATE TRANSFER MEMBER

This application claims provisional application Ser. No. 60/022,848, filed Jul. 31, 1996.

BACKGROUND OF THE INVENTION

This invention relates to a printer, in particular to a single-pass, multi-color electrostatographic printer, and to a method of single-pass multi-color electrostatographic printing.

Electrostatographic printers are known in which a toner image is electrostatically formed on a rotatable endless surface, such as a belt or a drum, and then ultimately transferred to a receiving material, which is usually in the form of paper sheets or web.

U.S. Pat. No. 4,796,048 to Bean discloses a copying apparatus in which a monochrome liquid toner image is formed on a photoconductor and then deposited on a transfer member in the form of a belt. The image is transferred from the belt to a substrate. In one disclosed embodiment, the solvent in the liquid toner is removed from the toner image while it is carried on the belt by the application of infra-red radiation and a vacuum. The image is then transferred to the substrate by heat and pressure and the belt is then optionally cooled before a further image is deposited thereon.

International patent document WO92/10793 discloses an imaging apparatus in which a liquid toner image is formed on a single photoconductor and then deposited on a transfer member in the form of a heated transfer drum and transferred from there to a substrate. The surface of the heated transfer drum may be cooled in advance of the deposition of the image. The multiple image is deposited on the transfer drum in steps, that is the transfer drum is rotated once for each color image being deposited. Cooling of the drum surface is necessary in advance of the deposition of each next color image in order to avoid back transfer of the toner to the photoconductor. Step-by-step deposition is slow, in particular because of a speed limitation which is inherent in the image writing system. Where, for example, four color images are deposited, the overall printing speed can be no faster than 25% of the image writing speed. Also, the apparatus disclosed by Spectrum introduces the risk of contamination of one toner developing unit by toner of another color. As a consequence, the disclosed apparatus includes a very thorough cleaning system for the photoconductor.

We prefer to avoid the use of liquid toners as disclosed in U.S. Pat. No. 4,796,048 and International patent document WO92/10793 especially where such toners are based on non-aqueous solvents such as Isopar (Trade Mark), which is mainly decane. Such solvents may not freely be released into the atmosphere for environmental reasons, and it is therefore necessary to include special arrangements to avoid such release.

Copiers and printers have been proposed which make use of toner in powder form. For example, U.S. Pat. No. 5,059,990 to Abreu et al. discloses a multi-pass multi-color printer in which a sheet of receiving material is moved in a recirculating path into contact with a single toner image carrying photoconductive belt, to which powder toner images of various colors are applied in turn. Such multiple-pass printers introduce considerable difficulties in the registration of the various toner images on the receiving material and also suffer from speed limitations similar to those referred to above in connection with the apparatus disclosed in International patent document WO92/10793.

U.S. Pat. No. 5,119,140 to Berkes et al. discloses a printer in which a number of powder toner images are deposited in turn onto an image receiving member to form a multiple toner image thereon. The multiple toner image is thereafter transferred by electrostatic means to a plain paper substrate. The efficiency of the electrostatic transfer to the substrate is dependant upon the nature and condition of the substrate and may not be 100% effective. For this reason Berkes et al. require the provision of a device for cleaning the image receiving member before a further image is deposited thereon.

In European patent document EP-220663-A, a single-pass, multi-color printer is disclosed in which a multiple toner image is formed on a transfer belt and then transferred to a substrate, normally in the form of a sheet of paper. The multiple toner image is formed on the transfer belt by sequential transfer from a photoreceptor belt onto which toner images of different colors are formed by electrostatographic means. In order to form the multiple toner image, the transfer belt has to circulate a number of times, corresponding at least to the number of different color toner images, before the multiple toner image can be transferred to the paper sheet. This construction introduces considerable problems in ensuring accurate registration of the different colored images and speed limitations as discussed above in connection with the apparatus disclosed by Abreu et al.

In U.S. Pat. No. 5,455,668 to De Bock et al., a single-pass multi-color printer is disclosed in which substrate in the form of a web passes a plurality of toner image forming stations where images of different colors are simultaneously transferred thereto in register.

Once one or more toner images have been transferred to the substrate, it is necessary to fix the images thereon. A number of fixing techniques are known, such as radiant heat fixing, and hot or cold pressure fixing. Radiant fixing has advantages of not introducing contact with the substrate but consumes significant energy, its efficiency is dependant upon the nature and characteristics of the substrate, questions may arise concerning the evaporation of environmentally unacceptable compounds which may be present in the substrate and the dry substrate may suffer from dimensional instability resulting in wrinkling and can become easily charged resulting, for example, in stacking problems. Where the thermal expansion coefficients of the substrate and the toner are significantly different, the use of radiant fixing can lead to distortion of the final printed image. Furthermore, radiant fixing is less suitable for substrates in the form of cut sheets as opposed to a web, since the position of the substrate path is more difficult to ensure. Pressure roller fixing on the other hand, while consuming less energy, is a contact method and the rollers used have a relatively short life-time.

SUMMARY OF THE INVENTION

It is an object of the present invention to provide an electrostatographic single-pass multi-color printer in which the aforesaid disadvantages are overcome.

According to a first aspect of the invention there is provided a single-pass, multi-color electrostatographic printer comprising:

- a transfer member;
- drive means for moving the transfer member along a continuous path;
- electrostatic deposition means for simultaneously depositing a plurality of toner images of different colors in powder form in register with each other onto the transfer member to form a charged multiple toner image thereon;

substrate feed means to feed substrate along a substrate path into contact with the transfer member, whereby the multiple toner image is transferred to at least one face of the substrate;

heating means for heating the multiple toner image on the transfer member in advance of the transfer of the multiple toner image to the substrate; and cooling means for cooling the transfer member following the transfer of the multiple toner image therefrom to the substrate to a temperature below the glass transition temperature $T_g$ of the toner, prior to the deposition of further toner images onto the transfer member.

According to a second aspect, the invention also provides a method of single-pass, multi-color electrostatographic printing comprising:

moving a transfer member along a continuous path;

electrostatically simultaneously depositing a plurality of toner images of different colors in powder form in register with each other onto the moving transfer member to form a charged multiple toner image thereon;

feeding substrate along a substrate path into contact with the moving transfer member, whereby the multiple toner image is transferred to at least one face of the substrate;

heating the multiple toner image on the moving transfer member in advance of the transfer of the multiple toner image to the substrate; and cooling the transfer member following the transfer of the multiple toner image therefrom to the substrate, to a temperature below the glass transition temperature $T_g$ of the toner, prior to the deposition of further toner images on the second transfer member.

The heating means for the transfer member may comprise infra-red radiant heating means, although other forms of heating including HF radiation, convection heating and conduction heating, for example the use of heated rollers, are also suitable. The temperature to which the multi-color image on the transfer member is heated is important. In particular, the surface of the toner image should contact the substrate at a temperature above the melting temperature of the toner, so as to ensure mixing of the toner particles of different colors, complete transfer of the mixed multiple toner image to the substrate and the fixing of the image on the substrate.

The cooling means for the transfer member may comprise convection or conduction cooling devices, for example, means for bringing the transfer member into contact with static cool air, a fan directing cool air onto the surface of the transfer member or a cooled roller over which the transfer member passes. The temperature to which the transfer member is cooled prior to the deposition of further multi-color toner image thereon is also important. In particular, the surface of the transfer member should be reduced to a temperature below the glass transition temperature $T_g$ of the toner, such as to about room temperature.

The transfer member plays the role of transferring the multiple toner image to the substrate. It is not necessary therefore that the transfer member has a photoconductive surface. Indeed, the need to heat and cool the transfer member in the apparatus according to the invention means that the use of conventional photoconductor materials is to be avoided, since the photoconductive properties of such materials can be sensitive to temperature changes.

The transfer member may comprise an outer surface formed of a material having a low surface energy, for example silicone elastomer (surface energy typically 20 dyne/cm), polytetrafluoroethylene, polyfluoralkylene and other fluorinated polymers. The transfer member is preferably in a form having a low mass, so that the surface thereof can be easily heated prior to the transfer of the multiple toner image to the substrate and easily cooled after the transfer thereto of a further multiple toner image from the primary belt. For this reason, while the transfer member can be in the form of a transfer roller or drum, it is preferably in the form of a transfer belt.

By specifying that the plurality of toner images of different colors are electrostatically simultaneously deposited onto the moving transfer member, we mean that either (Option 1) the multiple toner image is firstly formed on another member and then deposited as such onto the transfer member, or (Option 2) a plurality of toner image deposition devices operate simultaneously to deposit toner images at different locations along the transfer member path. In the latter alternative, the operation of the toner image deposition devices is so controlled in relation to each other as to ensure the desired registration of the various different images.

Thus, according to one embodiment of Option 1 of the invention, the transfer member is an intermediate transfer member and the means for forming a multiple toner image on the transfer member comprises:

a primary transfer member;

means for guiding the primary transfer member past a set of toner image producing stations whereby a plurality of toner images of different colors are formed on the primary transfer member in register with each other to form the multiple toner image on the primary transfer member, the intermediate transfer member being in contact with the primary transfer member downstream of the image producing stations, whereby the multiple toner image is electrostatically transferred from the primary transfer member to be deposited on the cooled intermediate transfer member. In this embodiment, the primary transfer member is preferably constituted by a primary belt.

The primary belt may have, for example, a toner image carrying surface formed of an electrically non-conductive material. The electrically non-conductive material is preferably selected from polyethylene terephthalate, silicone elastomer, polyimide (such as KAPTON—Trade Mark), and mixtures thereof. The primary belt may consist entirely of this material, or be in the form of a base material coated with such an electrically nonconductive material. The base material of the primary belt may be a metal, such as stainless steel, a polyimide, a polyvinyl fluoride, a polyester, and mixtures thereof. Polyester has the advantage of good mechanical and electrical characteristics and of being less sensitive to humidity.

While not wishing to be bound by theory, it is our understanding that it is generally preferred to transfer toner images from a material of relatively low surface energy to one of relatively high surface energy. This reduces the possibility of toner particles shearing during transfer which reduces the efficiency of the transfer process and leaves residual toner on the donor surface. Preferably therefore, the surface energy of the donor surface should be lower than that of the receiving surface. This can be achieved for the transfer of the image from the transfer member to the substrate, since the surface energy of the substrate, such as paper, is generally more than 45 dyne/cm. The transfer process is more efficient when the donor surface is at a higher temperature than the receiving surface. Thus the present invention requires heating of the toner image on the transfer member so as to maximize the efficiency of the transfer to the substrate.

However, the transfer of the multiple toner image from the primary belt to the transfer member is more difficult to achieve if the transfer member has a relatively low surface energy. While there would therefore be an advantage in heating the primary belt between the last image producing station and its contact with the intermediate transfer member, there is a risk of the temperature becoming too high. This problem can be avoided according to the present invention, by transferring the multiple toner image from the primary belt to be deposited on the intermediate transfer member by electrostatic means or by a combination of electrostatic means and heat. This has an added advantage of reducing the risk of toner-toner shearing at those portions of the image where toner of one color lies directly over toner of another color.

Drive to the primary belt is preferably derived from the drive means for the intermediate transfer member, by making use of adherent contact between the primary belt and the intermediate transfer member causing the primary belt and the intermediate transfer member to move in synchronism with each other. Adherent contact between the primary belt and the image producing stations may be used to ensure that the primary belt moves in synchronism with the image producing stations. The primary belt preferably passes over a guide roller positioned in opposition to the intermediate transfer member to form a nip or contact region therebetween.

Means for cleaning the primary belt, and optionally also means for cooling the primary belt, are preferably provided after contact with the intermediate transfer member.

Means for tensioning the primary belt may be provided in order to ensure good registration of the toner images thereon and to improve the quality of transfer of the multiple toner image therefrom to the intermediate transfer member. Means for controlling the transverse position and movement of the primary belt may also be included.

Each toner image producing station may comprise rotatable endless surface means, means for forming an electrostatic latent image on the rotatable endless surface means, means for developing the electrostatic image to form a toner image on the rotatable endless surface means and transfer means for transferring the toner image onto the primary belt. The rotatable endless surface means is preferably a drum having a photosensitive surface. The transfer means may comprise a transfer roller located at the face of the primary belt opposite to the drum, or a corona transfer device. When the transfer means is a transfer roller, the primary belt is in contact with the drum over a contact angle of less than 5°, measured at the axis of the rotatable endless surface means, e.g. substantially tangential contact. However, when the transfer means is a corona transfer device, the primary belt is preferably in contact with the drum over a contact angle of more than 5° so that adherent contact between the primary belt and the rotatable endless surface means enables drive to be reliably transmitted from the primary belt to the drum. The reliability of this transfer is enhanced by tensioning the primary belt.

Dry-development toners essentially comprise a thermoplastic binder consisting of a thermoplastic resin or mixture of resins including coloring matter, e.g. carbon black or coloring material such as finely dispersed pigments or soluble dyes.

The mean diameter of dry toner particles for use in magnetic brush development is about 10 $\mu$m; see Jerome L. Johnson, *Principles of Non Impact Printing*, Palatino Press, Irvine, Calif. 92715, pp. 64–85. For high-resolution development, the mean diameter may be from 1 to 5 $\mu$m; see e.g. British patent document GB-A-2180948 and International patent document WO-A-91/00548.

The thermoplastic resinous binder may be formed of polyester, polyethylene, polystyrene and copolymers thereof, e.g. styrene-acrylic resin, styrene-butadiene resin, acrylate and methacrylate resins, polyvinyl chloride resin, vinyl acetate resin, copoly(vinyl chloride-vinyl acetate) resin, copoly(vinyl chloride-vinyl acetate-maleic acid) resin, vinyl butyral resins, polyvinyl alcohol resins, polyurethane resins, polyimide resins, polyamide resins and polyester resins. Polyester resins are preferred for providing high gloss and improved abrasion resistance. Such resins usually have a glass transition point of more than 45° C., usually above 54° C. The presence of other ingredients in the toner particles, such as the colorant, usually have no significant effect upon the glass transition temperature. The volume resistivity of the resins is preferably at least $10^{13}$ Ω-cm.

Suitable toner compositions are described in European patent documents EP-A-601235 and EP-A-628883, and in International patent documents WO94/27192, WO94/27191 and WO94/29770. The glass transition temperatures of most common toner compositions are similar at about 55° C. and a melting point within the range of 90° C. to 155° C.

The use of a transfer belt in place of a transfer roller as the intermediate transfer member enables the contact area between this member and the primary belt to be greater. This enables the adherent contact therebetween to be improved thereby providing a more reliable transmission of drive from the intermediate transfer member to the primary belt without increase in pressure. Furthermore, the use of a transfer belt has other advantages over, for example, the use of a transfer roller. One run or section of the transfer belt may be heated while the other run is cooled. In this manner, the temperature of the transfer belt at its point of contact with the substrate can be higher than its temperature at its point of contact with the primary belt, leading to an improvement in toner transfer and reducing the chances of offset ghost image effects. For the production of glossy images, it is advisable that the surface of the intermediate transfer member be as flat as possible. In particular it is advantageous if the surface roughness $R_a$ is less than 0.2 $\mu$m. For the production of matt images, the surface roughness may be higher.

The substrate is preferably in the form of a web. Web cutting means, optionally together with a sheet stacking device may be provided downstream of the intermediate transfer member. Alternatively, the web is not cut into sheets, but wound onto a take-up roller.

The substrate may alternatively be in the form of cut sheets, or other articles of suitable shape. The present invention is particularly of advantage in the printing of substrates of significant thickness and rigidity.

Furthermore, the present invention has the advantage, in comparison to those printing devices in which a toner image is electrostatically transferred directly to the substrate, that the electrical condition of the substrate is less critical. There is, for example, no need to condition the substrate to adjust its moisture content to within a specified range, nor to condition the environment of the printer. This feature represents a useful advantage over the printers disclosed, for example, in U.S. Pat. No. 5455668 referred to above. The range of substrate types which can be used is also increased, to include for example substrates formed of synthetic materials, of flimsy materials or of irregular shape.

Means for heating the substrate are preferably provided in advance of contact with the intermediate transfer member.

This may be achieved by the use of heating means selected from infra-red and high-frequency radiant heating means, convection heating means, conduction heating means, such as heated rollers, and other known heating means.

The printer according to the invention may be adapted for duplex printing, by comprising:

electrostatic deposition means for depositing a second such multiple toner image on a second transfer member, the substrate feed means being adapted to feed substrate along a substrate path into contact with the second transfer member, whereby the second multiple toner image is transferred to the opposite face of the substrate; and means for heating the second multiple toner image on the second transfer member in advance of the transfer of the second multiple toner image to the substrate; and means for cooling the second transfer member following the transfer of the second multiple toner image therefrom to the substrate prior to the deposition of further toner images on the second transfer member.

The second transfer member may be a second intermediate transfer member and the means for forming a second multiple toner image on the second transfer surface may then comprise:

a second primary transfer member;

means for guiding the second primary transfer member past a second set of toner image producing stations whereby a second plurality of toner images of different colors are transferred to the second primary transfer member in register with each other to form the second multiple toner image on the second primary transfer member, the second intermediate transfer member being in contact with the second primary transfer member downstream of the second set of image producing stations.

In this embodiment, the first and second intermediate transfer members may be positioned in opposition to each other to form a nip or contact region therebetween, through which the substrate path passes. Drive to the second intermediate transfer member may be derived from the first intermediate transfer member or may be derived from a separate drive motor, controlled to drive the second intermediate transfer member in synchronism with the first intermediate transfer member.

Alternatively, the first and second intermediate transfer members are spaced from each other, each being provided with a respective counter roller to define a nip or contact region through which the substrate passes. When the substrate is in the form of a web, the substrate may be in contact with a position sensing device between the first and second intermediate transfer members, the output of the sensing device can be used to control the drive motors of the respective intermediate transfer members to ensure that the intermediate transfer members run at the same speed.

In an embodiment of Option 2 of the invention, the primary belt and the intermediate transfer member are constituted by one and the same member. The transfer member may be constituted by a belt and there are provided means for guiding the belt past a set of toner image producing stations whereby a plurality of toner images of different colors are transferred to the belt in register with each other to form the multiple toner image on the belt, and the substrate feed means are arranged to feed substrates along a substrate path into contact with the belt.

In order to reduce energy loss to the environment, we prefer that the means for heating the toner image on the transfer member is in heat exchange relationship with the means for cooling the transfer member after transfer. For example, the means for heating the multiple toner image on the transfer member comprises a pre-heating roller and the means for cooling the transfer member comprises a pre-cooling roller, the pre-heating roller and the pre-cooling roller being in heat exchange relationship with each other. This heat exchange relationship can be achieved for example by each of the heating and cooling rollers being hollow rollers through which a heat exchange fluid, such as water, is caused to flow. In this way heat extracted by the cooling roller is transferred to the heating roller and contributes to the heating of the toner image on the transfer member. We are aware of European patent document EP-0399794 disclosing a powder transport, fusing and imaging apparatus in which a writing belt having a low free surface energy moves in a cyclic path to transfer monochrome toner from a first location to a second location at a different temperature, and counter moving portions of the belt exchange heat with each other so that minimum energy is lost to the environment. The monochrome toner image is transferred to the belt at the first location and transferred from the belt to a substrate at the second location. However, European patent document EP-0399794 discloses achieving the heat exchange by contact between opposing runs of the belt, which we prefer to avoid, since this introduces undesirable friction, heat and wear.

In order not to disturb the multiple toner image on the transfer member between the deposition of the image thereon and the transfer of the image to the substrate, we prefer that the surface of the transfer member which carries the image is free of contact with any other member. Thereby, undesirable transfer of the image, or a part thereof, from the transfer member is avoided. Thus, where for example the transfer member is in the form of a belt, rollers or other guide means, contact the belt on the surface thereof opposite to that carrying the image, at least between the deposition of the image and its transfer to the substrate.

DESCRIPTION OF PREFERRED EMBODIMENTS

The invention will now be further described, purely by way of example, by reference to the accompanying drawings in which.

Figure 1:
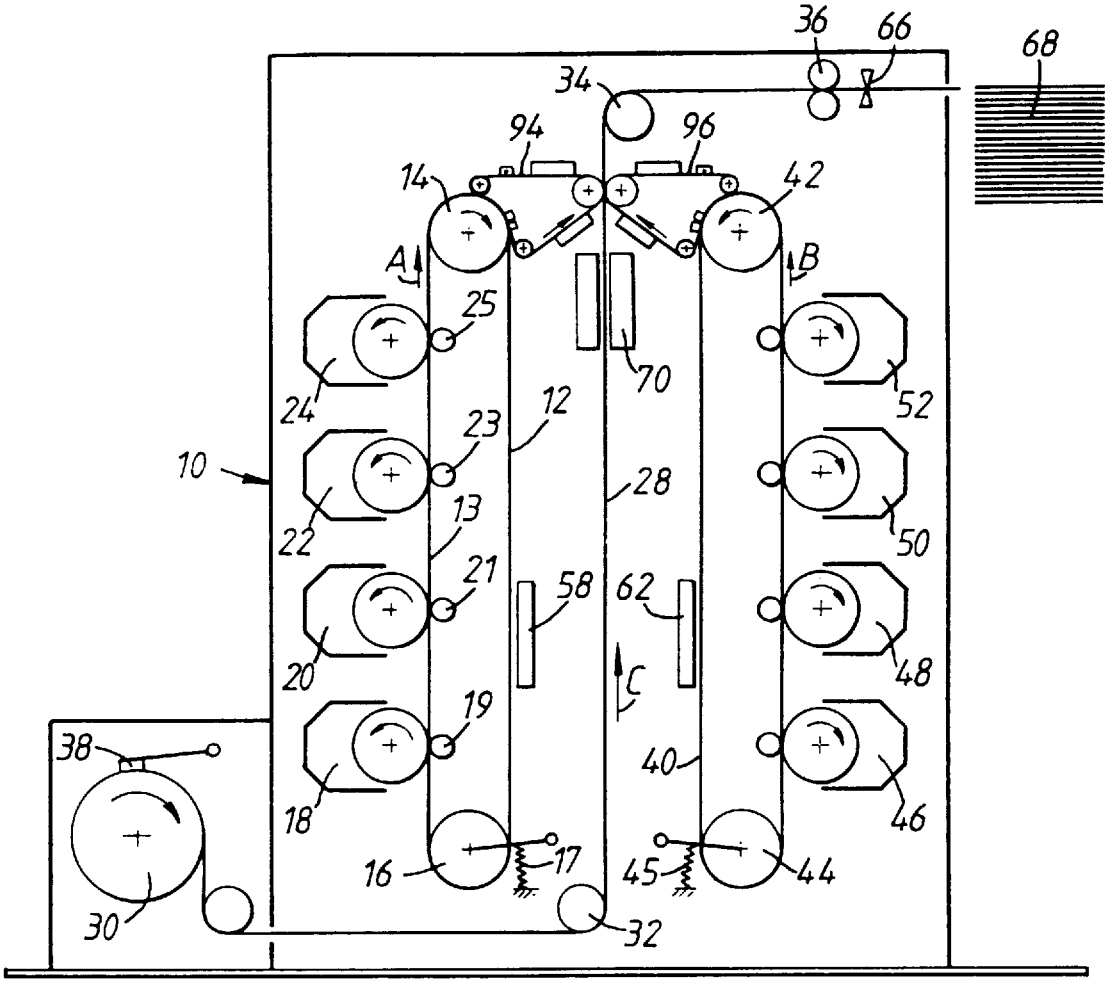
FIG. 1 shows a duplex printer according to the invention.
Figure 2:
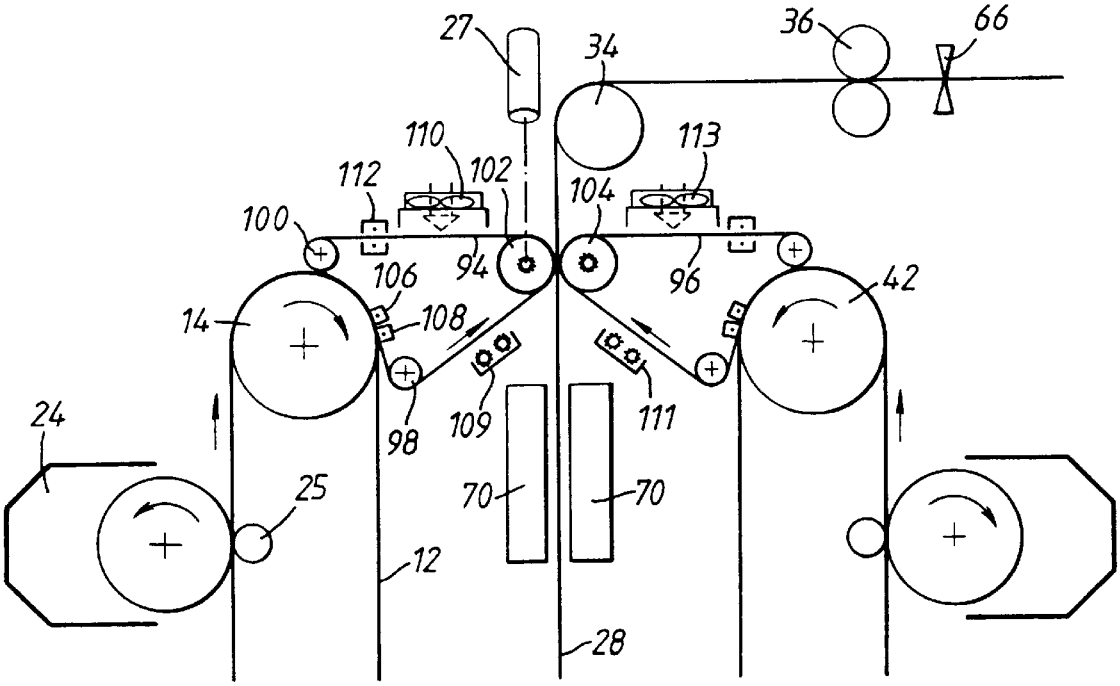
FIG. 2 is an enlarged view of part of the printer shown in FIG. 1.

FIGS. 1 and 2 show a single-pass, multi-color duplex electrostatographic printer 10. The printer comprises a first primary seamless belt 12 which passes over major guide rollers 14, 16. The primary belt 12 moves in a substantially vertical direction shown by the arrow A past a set of four toner image producing stations 18, 20, 22, 24. At the four toner image producing stations 18, 20, 22, 24, a plurality of toner images of different colors are transferred by transfer rollers 19, 21, 23, 25 to the primary belt in register with each other to form a first multiple toner image, as described in more detail below with reference to FIG. 3, as disclosed in European patent document EP-629927. These image producing stations may be similar to each other except in respect of the color of the toner with which they are supplied.

A spring 17 acting on the major guide roller 16 is provided for tensioning that part 13 of the primary belt 12 which extends past the toner image producing stations 18, 20, 22, 24.

An intermediate transfer member in the form of a seamless transfer belt 94, formed of an electrically insulating material such as a KAPTON (Trade Mark), is in contact with the primary belt 12 downstream of the last image producing station 24. As shown in FIG. 2, the transfer belt 94 passes over a pair of spaced guide rollers 98, 100 which are so positioned as to bring the transfer belt 94 into contact with primary belt 12 as it passes over the grounded upper guide roller 14. The transfer belt 94 also passes over a first heated guide roller 102. The heated guide roller 102 is driven by a master drive motor 27. Drive is therefore transmitted in turn from the drive motor 27, via the transfer belt 94 to the primary belt 12 downstream of the toner image producing stations and to the toner image producing stations themselves.

The major guide roller 14 and the intermediate transfer belt 94 are positioned relative to each other to form a nip or contact region therebetween, through which the primary belt 12 passes. Adherent contact between the primary belt and the intermediate transfer belt causes the primary belt and the intermediate transfer belt to move in synchronism with each other.

A paper web 28 is unwound from a supply roll 30 and passes into the printer. The web passes over freely rotating rollers 32 and 34 in the direction of the arrow C to a pair of web drive rollers 36, driven by a slave motor (not shown). Tension in the web 28 is controlled by application of a brake 38 applied to the supply roll 30.

The first multiple toner image adhering to the surface of the primary belt 12 is transferred to the moving intermediate transfer belt 94 by a transfer corona device 106. The moving intermediate transfer belt 94 is in face-to-face contact with the primary belt 12 over a wrapping angle determined by the position of guide rollers 98, 100. The charge sprayed by the transfer corona device 106, being on the opposite side of the intermediate transfer belt to the primary belt 12, and having a polarity opposite in sign to that of the charge on the toner particles, attracts the toner particles away from the primary belt 12 and onto the surface of the intermediate transfer belt 94. The transfer corona device typically has its corona wire positioned about 7 mm from the housing which surrounds it and 7 mm from the intermediate transfer belt. A typical transfer corona current is about 3 $\mu$A/cm corona width. The transfer corona device 106 also serves to generate a strong adherent force between the intermediate transfer belt 94 and the primary belt 12, causing the latter to be rotated in synchronism with the movement of the intermediate transfer belt 94 and urging the toner particles into firm contact with the surface of the intermediate transfer belt 94. A web discharge corona device 108 driven by alternating current is provided circumferentially beyond the transfer corona device 106 and serves to eliminate sparking as the intermediate transfer belt 94 leaves the surface of the primary belt 12.

After the transfer of the multiple toner image thereto, the intermediate transfer belt 94 passes an infra-red radiant heater 109 which raises the temperature of the toner particles to about 150° C., the optimum temperature for final transfer to the paper web 28. So as to ensure that the toner particles on the intermediate transfer belt 94 are not subjected to sudden cooling as they reach the guide roller 102, the latter is heated. By the use of an elevated temperature at the point of transfer to the paper web 28, and by virtue of the higher surface energy of the paper web relative to the intermediate transfer belt 94, the transfer of toner is 100% complete, so that there may be no necessity to clean excess toner particles from the intermediate transfer belt. Nevertheless, a cleaning device, such as a cleaning roller, may be provided to remove any residual toner particles from the intermediate transfer belt, which residual particles may result during start-up or run-down of the printer.

After leaving the heated guide roller 102 the temperature of the intermediate transfer belt 94 is reduced by a cooling device 110 and any residual charge on the intermediate transfer belt is removed by an opposing pair of corona discharge devices 112.

The transfer belt 94 is preferably tensioned by means not shown, for example by means of a spring loaded tensioning roller. If this tensioning roller is located on the upper run of the intermediate transfer belt 94, it may suitably be in the form of a water cooled roller, in which event it assists in the cooling of the intermediate transfer belt 94 after transfer, in addition to, or in place of the cooling device 110.

The printer shown in FIGS. 1 and 2 is adapted for duplex printing. To achieve this, the printer further comprises a second primary belt 40 which passes over major guide rollers 42, 44. A spring 45 acting on the major guide roller 44 is provided for tensioning the second primary belt 40 whereby drive is transmitted from the major guide roller 42 to the second primary belt 40 to drive the primary belt in the direction shown by the arrow B past a second set of four toner image producing stations 46, 48, 50, 52. At the four toner image producing stations 46, 48, 50, 52, a plurality of toner images of different colors are transferred to the primary belt in register with each other to form a second image.

A second intermediate transfer belt 96 is in contact with the second primary belt 40 downstream of the last image producing station 52 of the second set. After the transfer of the second multiple toner image thereto, the intermediate transfer belt 96 passes an infra-red radiant heater 111 which raises the temperature of the toner particles, as described in connection with the first multiple image.

The first heated guide roller 102 is positioned in opposition to a second heated guide roller 104, referred to in more detail below, to form a transfer nip or contact region therebetween, through which the substrate in the form of a paper web 28 passes. The intermediate transfer belts serve to feed the paper web through the printer. Thus the paper web 28 is brought into contact with the first and second intermediate transfer belts 94, 96 whereby the first multiple toner image is transferred to one face of the paper web while the second multiple toner image is transferred to the opposite face thereof.

After leaving the heated guide roller 104 the temperature of the second intermediate transfer belt 96 is reduced by a cooling device 113.

Each primary belt 12, 40 has a toner image carrying surface formed for example of polyethylene terephthalate.

After contact of the intermediate transfer belt 94, the belt 12 passes a cleaning station 58, where residual toner is removed from the primary belt and any residual electrostatic charge thereon is neutralized. Similarly, a second cleaning station 62 is provided for the second primary belt 40.

Downstream of the drive roller pair 36, the paper web passes to a cutting station 66 where the web is cut into sheets which are collected in a stack 68. The length of the images formed on the paper web may, of course, be of any length, independent of the dimensions of the components of the printer, especially the image producing stations. The web can be cut into sheets of variable length, depending on the length of the image transferred thereto.

An infra-red radiant heater 70 for heating the paper web 28 is provided upstream of the intermediate transfer belts 94, 96, in order to avoid a sudden change in temperature at the transfer nip.

Figure 3:
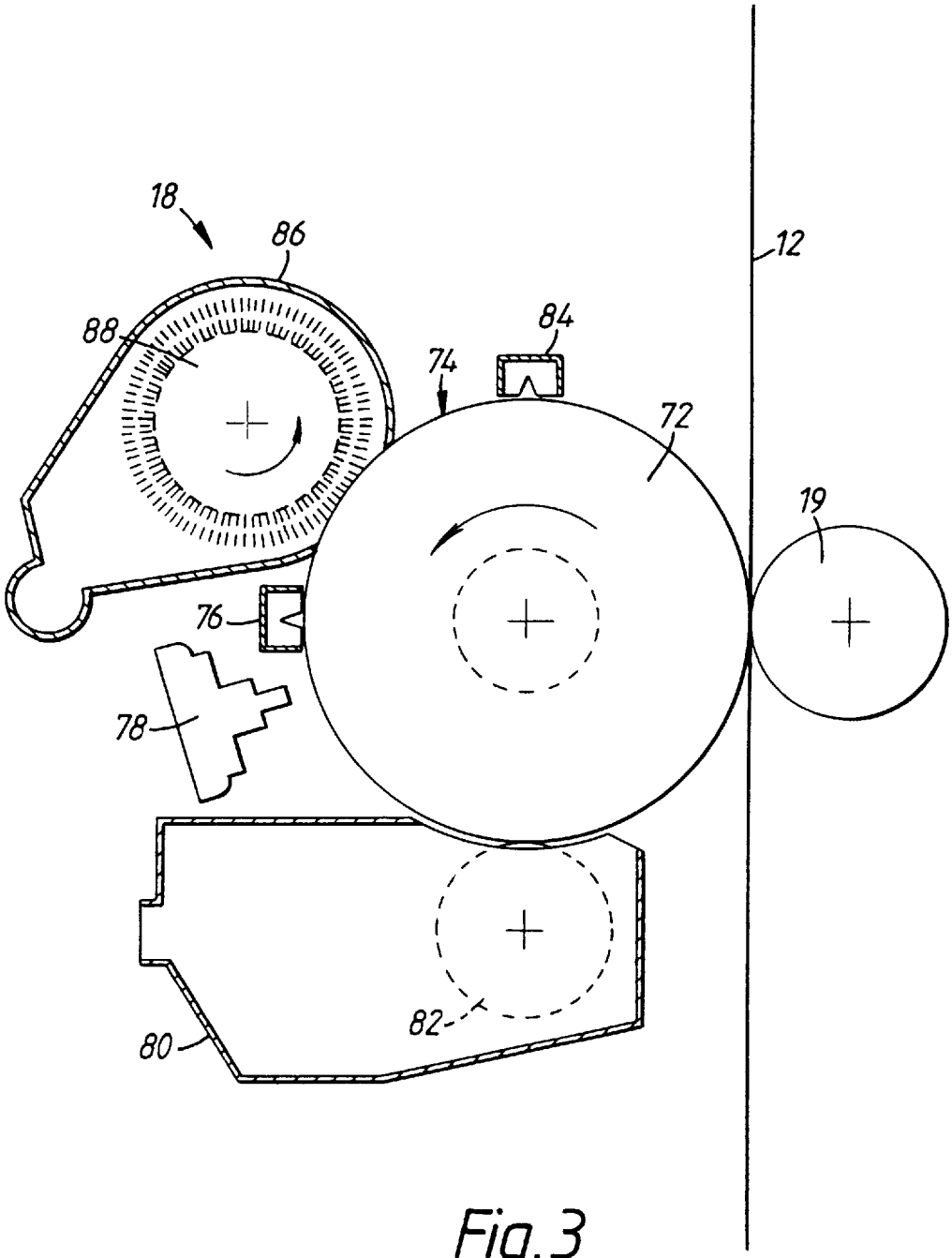
FIG. 3 shows details of one of the image-forming stations of the printer shown in FIG. 1.

As shown in FIG. 3, which shows for example the image producing station 18 of FIG. 1, each toner image producing station comprises rotatable endless surface means in the form of a cylindrical drum 72 having a photoconductive outer surface 74. Circumferentially arranged around the drum 72 there is a main corotron or scorotron charging device 76 capable of uniformly charging the drum surface 74, for example to a potential of about −600 V, an exposure station 78 which may, for example, be in the form of a scanning laser beam or an LED array, which will image-wise and line-wise expose the photoconductive drum surface 74 causing the charge on the latter to be selectively reduced, for example to a potential of about −250 V, leaving an image-wise distribution of electric charge to remain on the drum surface 74. This so-called "latent image" is rendered visible by a developing station 80 which by means known in the art will bring a developer in contact with the drum surface 74. The developing station 80 includes a developer drum 82 which is adjustably mounted, enabling it to be moved radially towards or away from the drum 72 for reasons as will be explained further below. According to one embodiment, the developer contains (i) toner particles containing a mixture of a resin, a dye or pigment of the appropriate color and normally a charge-controlling compound giving triboelectric charge to the toner, and (ii) carrier particles charging the toner particles by frictional contact therewith. The carrier particles may be made of a magnetizable material, such as iron or iron oxide. In a typical construction of a developer station, the developer drum 82 contains magnets carried within a rotating sleeve causing the mixture of toner and magnetizable material to rotate therewith, to contact the surface 74 of the drum 72 in a brush-like manner. Negatively charged toner particles, triboelectrically charged to a level of, for example 9 $\mu$C/g, are attracted to the photo-exposed areas on the drum surface 74 by the electric field between these areas and the negatively electrically biased developer so that the latent image becomes visible.

After development, the toner image adhering to the drum surface 74 is transferred to the moving primary belt 12 by application of the biased transfer roller 19. The moving primary belt 12 is in face-to-face, substantially tangential contact with the drum surface 74 as determined by the position of the guide rollers 14 and 16; see FIG. 1.

Thereafter, the drum surface 74 is pre-charged to a level of, for example −580 V, by a pre-charging corotron or scorotron device 84. The pre-charging makes the final charging by the corona 76 easier. Thereby, any residual toner which might still cling to the drum surface may be more easily removed by a cleaning unit 86 known in the art. Final traces of the preceding electrostatic image are erased by the corona 76. The cleaning unit 86 includes an adjustably mounted cleaning brush 88, the position of which can be adjusted towards or away from the drum surface 74 to ensure optimum cleaning. The cleaning brush 88 is grounded or subject to such a potential with respect to the drum as to attract the residual toner particles away from the drum surface. After cleaning, the drum surface is ready for another recording cycle.

FIGS. 4 to 8 show various modifications of the printer shown in FIGS. 1 to 3. In these figures, like features are indicated with like reference numerals.

Figure 4:
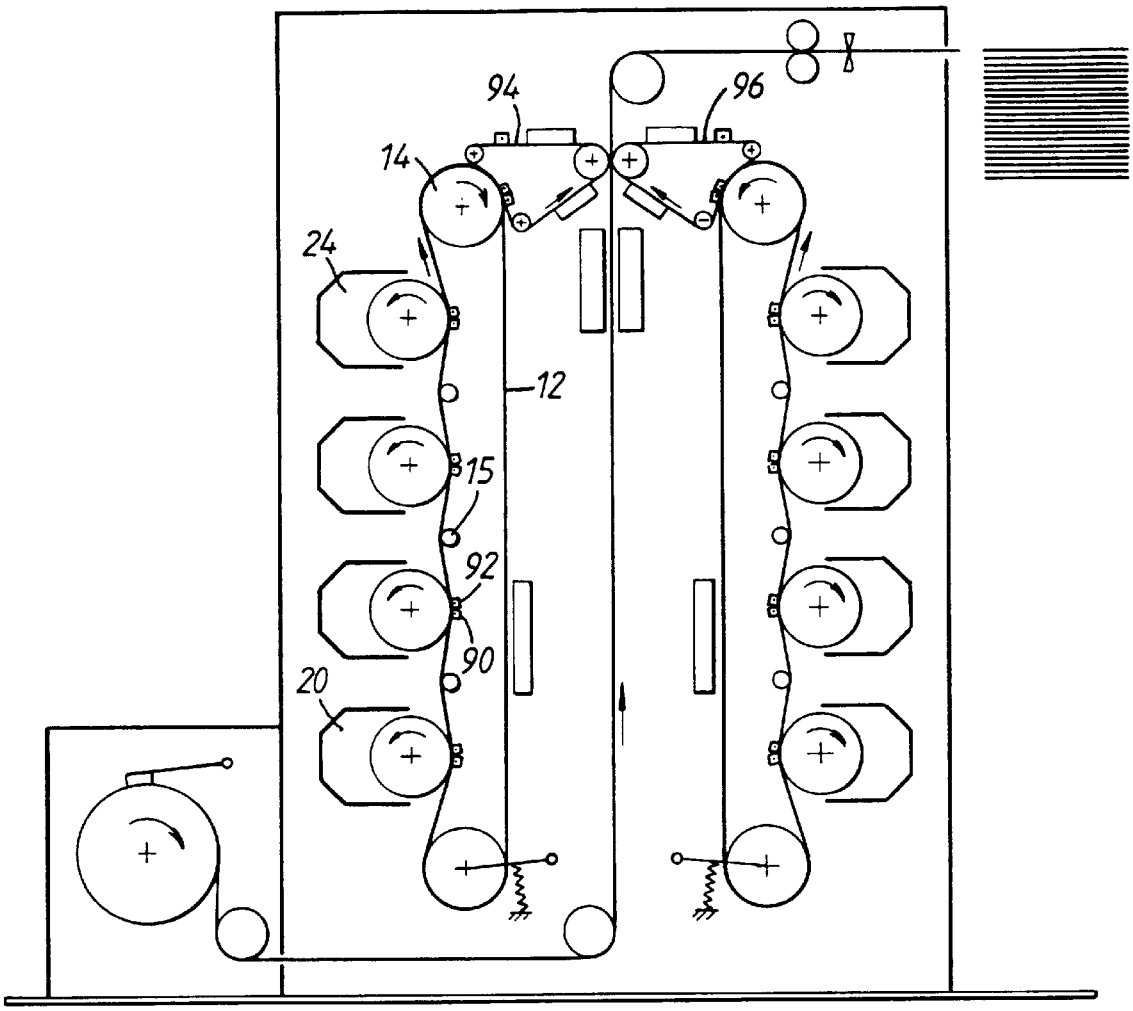
FIG. 4 shows a modification of the duplex printer shown in FIG. 1.

The embodiment shown in FIG. 4 is similar to that shown in FIG. 1 except that the biased rollers 19 etc. of the embodiment shown in FIG. 1 are each replaced by a pair of corona devices, namely a transfer corona device 90 and a primary belt discharge corona device 92 and the primary belt 12 is guided between the image producing stations over intermediate guide rollers 15.

Figure 5:
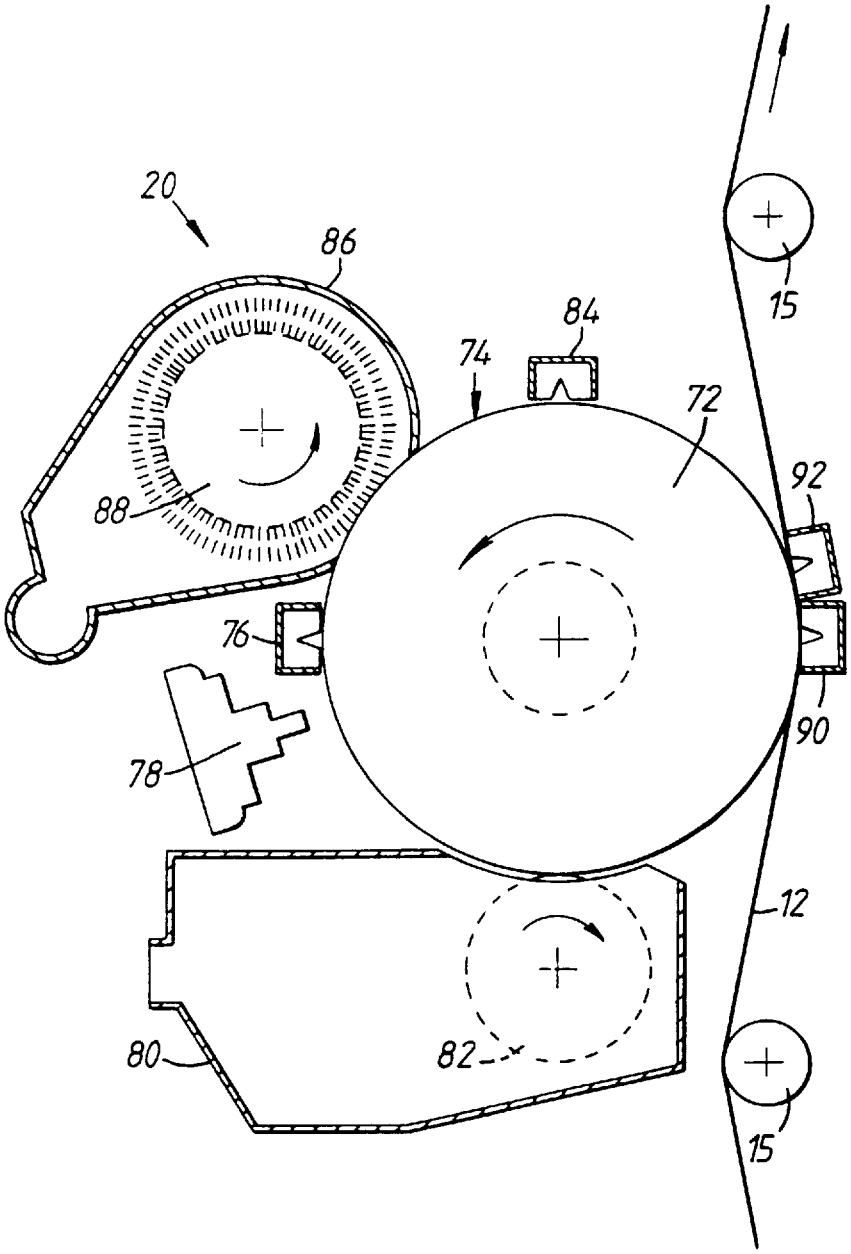
FIG. 5 shows details of one of the image-forming stations of the printer shown in FIG. 4.

As shown in FIG. 5, which shows for example the image producing station 20 of FIG. 4, after development, the toner image adhering to the drum surface 74 is transferred to the moving primary belt 12 by a transfer corona device 90. The moving primary belt 12 is in face-to-face contact with the drum surface 74 over a small wrapping angle determined by the position of guide rollers 15. The charge sprayed by the transfer corona device 90, being on the opposite side of the primary belt to the drum, and having a polarity opposite in sign to that of the charge on the toner particles, attracts the toner particles away from the drum surface 74 and onto the surface of the primary belt 12. The transfer corona device typically has its corona wire positioned about 7 mm from the housing which surrounds it and 7 mm from the primary belt. A typical transfer corona current is about 3 $\mu$/cm primary belt width. The transfer corona device 90 also serves to generate a strong adherent force between the primary belt 12 and the drum surface 74, causing the latter to be rotated in synchronism with the movement of the primary belt 12 and urging the toner particles into firm contact with the surface of the primary belt 12. The primary belt, however, should not tend to wrap around the drum beyond the point dictated by the positioning of a guide roller 15 and there is therefore provided circumferentially beyond the transfer corona device 90 a primary belt discharge corona device 92 driven by alternating current and serving to discharge the primary belt 12 and thereby allow the primary belt to become released from the drum surface 74. The primary belt discharge corona device 92 also serves to eliminate sparking as the primary belt leaves the surface 74 of the drum.

The moving primary belt 12 is in face-to-face contact with the drum surface 74 as determined by the position of the guide rollers 14 and 16 and the intermediate guide rollers 15.

Figure 6:
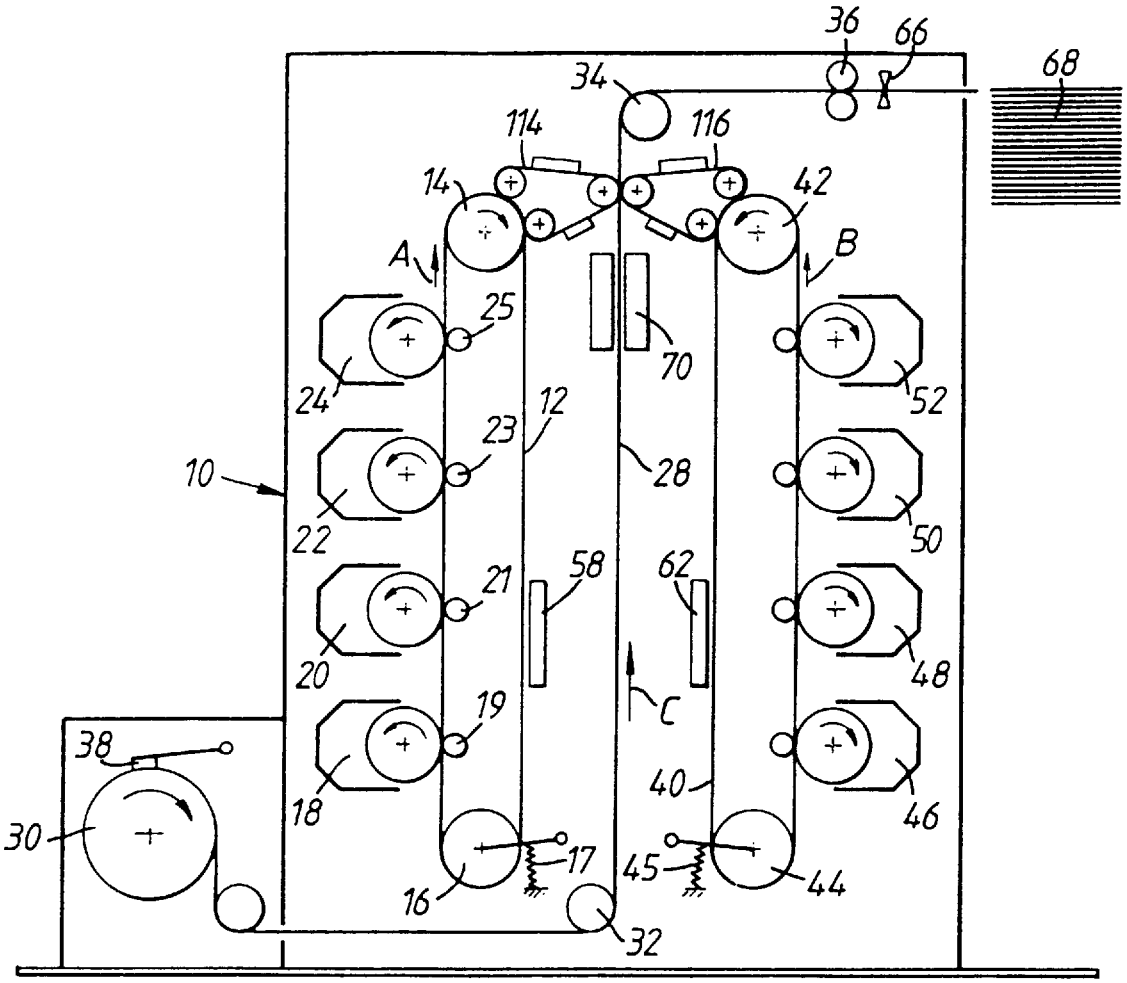
FIG. 6 shows another modification of the duplex printer shown in FIG. 1.
Figure 7:
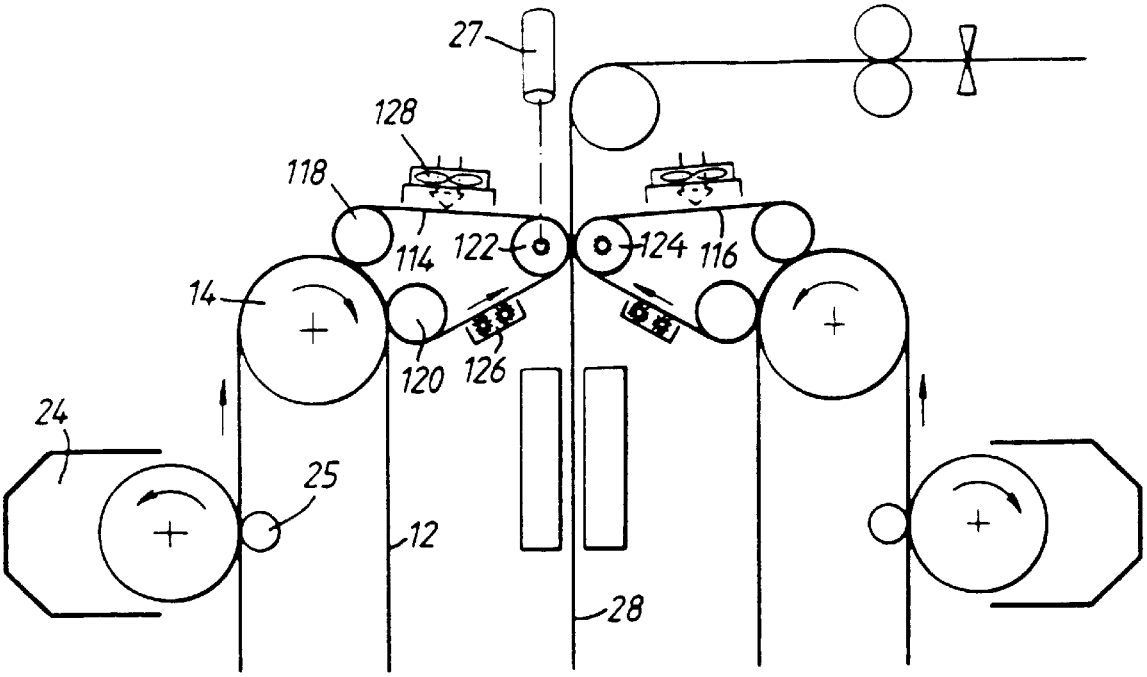
FIG. 7 is an enlarged view of part of the printer shown in FIG. 6.

In the embodiment shown in FIGS. 6 and 7, the first and second heat intermediate transfer belts 94, 96 of the embodiment of FIG. 1 are replaced respectively by first and second intermediate transfer belts 114, 116 formed for example of a metal (e.g. steel) backing coated with a silicone. As shown more clearly in FIG. 7, the first intermediate transfer belt 114 passes over a pair of spaced guide rollers 118, 120 which are urged by spring pressure towards the grounded guide roller 14 and are so positioned as to bring the first intermediate transfer belt 114 into contact with the primary belt 12 as the intermediate transfer belt 114 passes over the upper guide roller 14. The first intermediate transfer belt 114 also passes over a first heated guide roller 122 which is positioned adjacent a second heated guide roller 124 to form a nip or contact region therebetween, through which the paper web 28 passes. The pair of spaced guide rollers 118, 120 may be replaced by a single guide roller if desired.

The multiple toner image adhering to the surface of the primary belt 12 is transferred to the moving intermediate transfer belt 114 by pressure. The transfer of the multiple toner image from the primary belt 12 to the intermediate transfer belt 114 is improved by applying a voltage of appropriate polarity by means not shown to the metal backing of the intermediate transfer belt 114. The moving intermediate transfer belt 114 is in face-to-face contact with the primary belt 12 over a wrapping angle determined by the position of guide rollers 118, 120. The spring pressure applied to the guide rollers 118, 120 towards the guide roller 14 serves to generate a strong adherent force between the intermediate transfer belt 114 and the primary belt 12, causing the latter to be rotated in synchronism with the movement of the intermediate transfer belt 114 and urging the toner particles into firm contact with the surface of the intermediate transfer belt 114.

After the transfer of the multiple toner image thereto, the intermediate transfer belt 114 passes an infra-red radiant heater 126 which raises the temperature of the toner particles to about 150° C. After leaving the heated guide roller 122, the temperature of the intermediate transfer belt 114 is reduced by a cooling device 128.

The embodiment shown in FIGS. 6 and 7 has the advantage over the embodiment shown in FIG. 1 that by avoiding the use of corona discharge devices less ozone is generated in use and it is possible to use metal backed belts which are usually stronger than belts formed of other materials.

Figure 8:
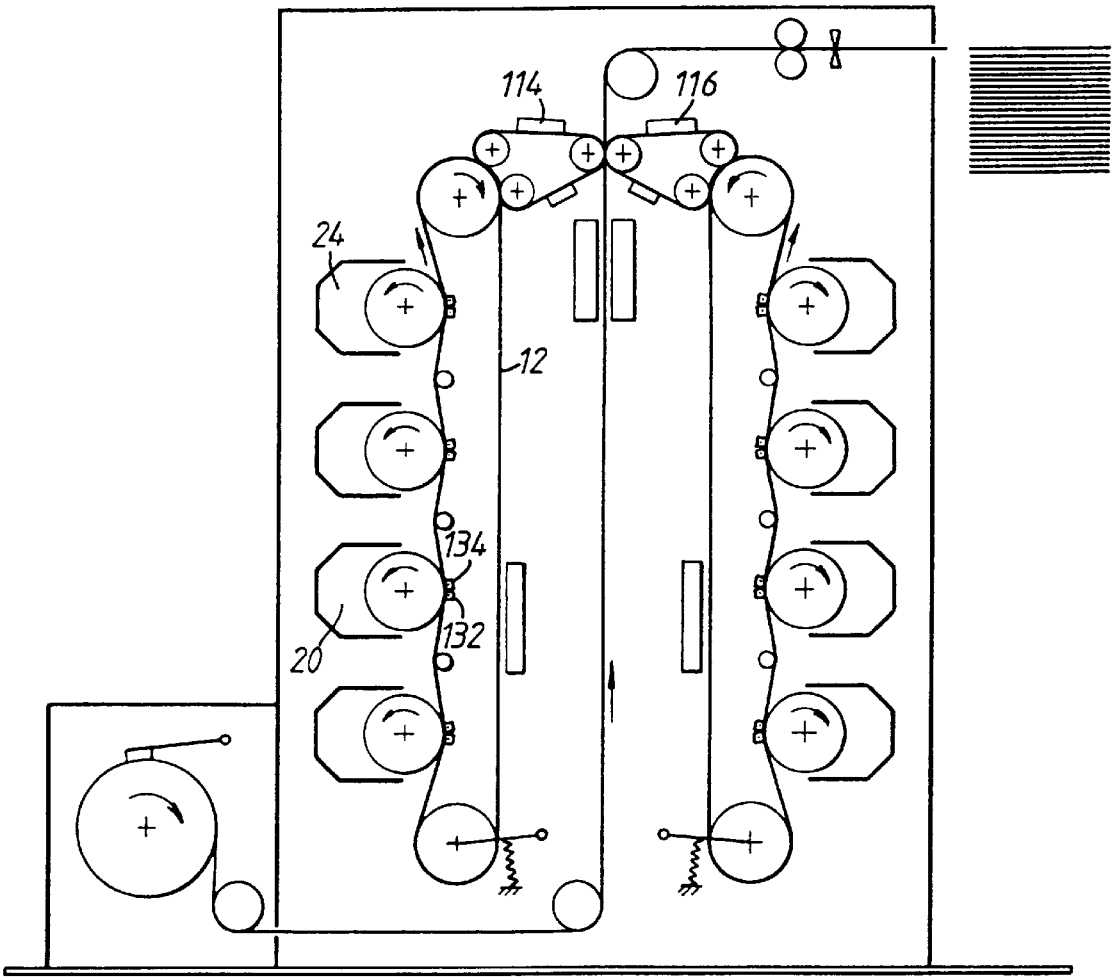
FIG. 8 shows a modification of the duplex printer shown in FIG. 6.

The embodiment shown in FIG. 8, is similar to that shown in FIG. 6 and 7 except that the biased rollers 19 etc. of the embodiment shown in FIG. 6 are each replaced by a pair of corona devices, namely a transfer corona device 132 and a web discharge corona device 134, which operate as described in connection with FIGS. 4 and 5 and the primary belt 12 is guided between the image producing stations over intermediate guide rollers.

Figure 9:
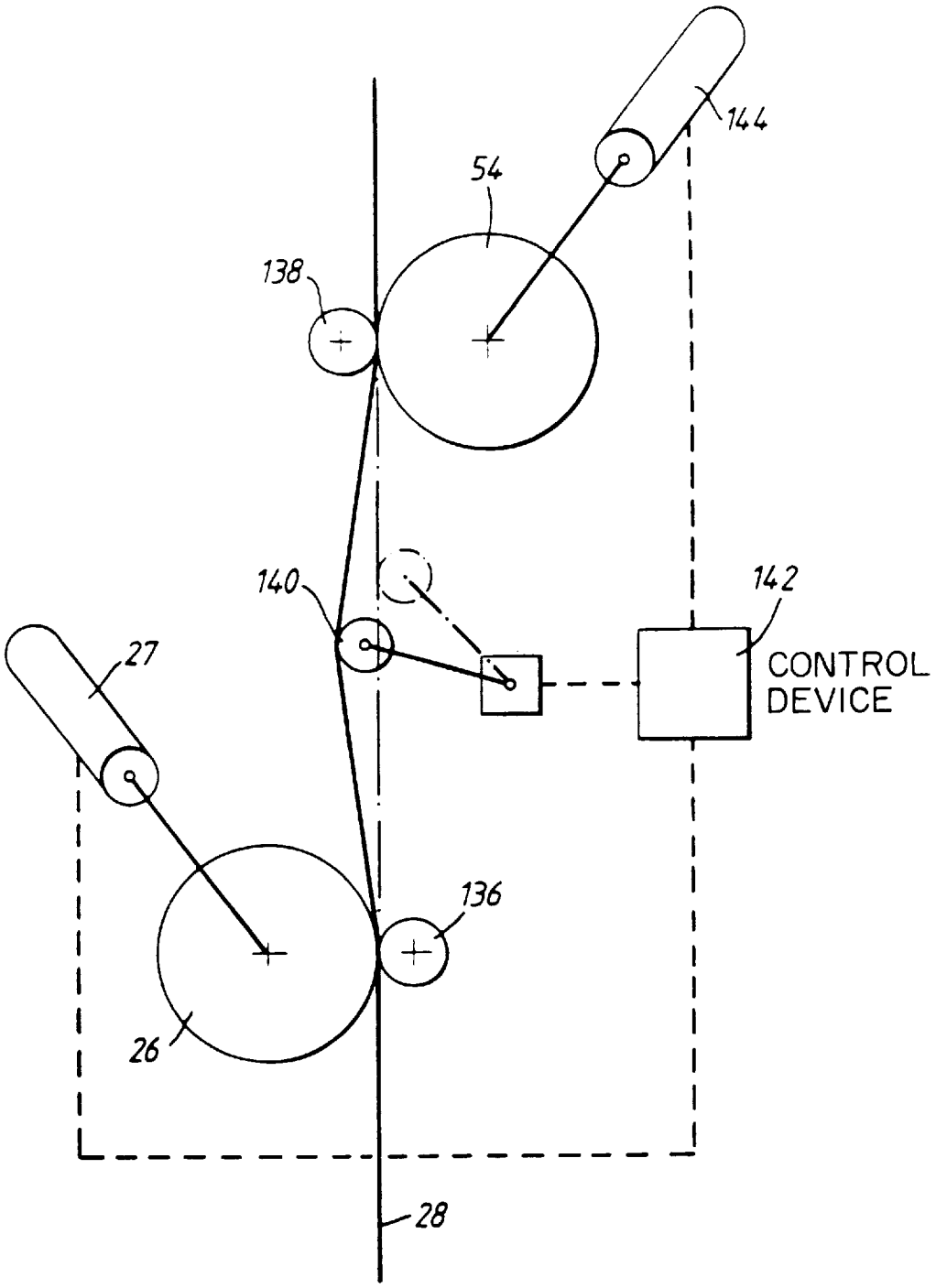
FIG. 9 shows a modification of part of the embodiment shown in FIG. 1.

FIG. 9 shows a modification of the embodiment shown in FIG. 1, which modification can be utilized with suitable adaptation to any of the embodiments shown in FIGS. 1 to 8.

In the alternative embodiment shown in FIG. 9, the first and second heated guide rollers 26, 54 are spaced from each other, each being provided with a respective counter roller 136, 138 to define a nip or contact region through which the paper web 28 passes. Between the first and second intermediate transfer belts 94, 96 the paper web 28 is in contact with position sensing device 140, the output of which is connected to a control device 142 which, in a known manner, serves to control the master drive motor 27 and the slave drive motor 144 of the respective intermediate transfer belts to ensure that the intermediate transfer belts run at the same speed. The advantage of this embodiment is that the pressure rollers 136, 138 can be suitably chosen to form a nip which is independent of the flexibility of the intermediate transfer belts.

Figure 10:
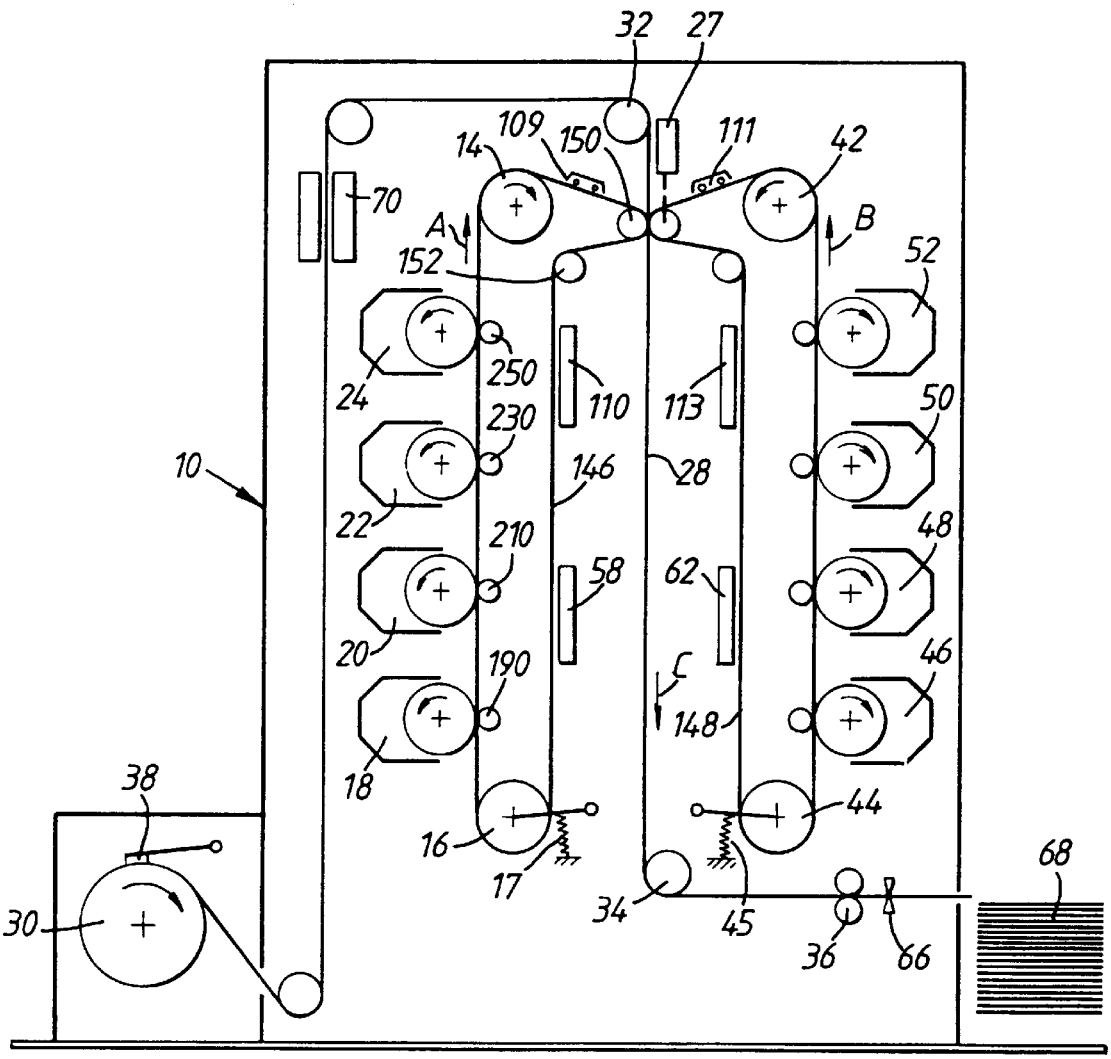
FIG. 10 illustrates an alternative embodiment of the invention in which the primary belt and the intermediate transfer member are constituted by one and the same member.

FIG. 10 shows an alternative embodiment of the invention in which the primary belt 12 and the intermediate transfer member 94 of FIG. 1 are constituted by one and the same member. Thus, FIG. 10 shows a single-pass, multi-color duplex electrostatographic printer 10. The printer comprises a first seamless transfer belt 146 which passes over major guide rollers 14, 16. The transfer belt 146 moves in the direction shown by the arrow A past a set of four toner image producing stations 18, 20, 22, 24. At the four toner image producing stations 18, 20, 22, 24, a plurality of toner images of different colors are transferred by biased transfer rollers 190, 210, 230, 250 to the transfer belt 146 in register with each other to form a first multiple toner image, as described in more detail above with reference to FIG. 3. A spring 17 acting on the major guide roller 16 is provided for tensioning that part of the transfer belt 146 which extends past the toner image producing stations 18, 20, 22, 24. The transfer belt 146 is, for example, formed of an electrically insulating material such as a KAPTON (Trade Mark) or, alternatively, a metal belt having a toner image carrying surface formed of a silicone elastomer. In the latter case, it is advantageous to apply a voltage of, say, 1.0 kV to the rear metal surface of the belt to improve the efficiency of transfer of toner images thereto. The transfer belt 146 also passes over two guide rollers, namely a first heated guide roller 150 and a non-heated, optionally cooled, guide roller 152. The first heated guide roller 150 is positioned in opposition to a second heated guide roller to form a transfer nip or contact region therebetween, through which substrate in the form of a paper web 28 passes. The heated guide roller 150 is driven by a drive motor 27. Drive is therefore transmitted in turn from the drive motor 27, via the transfer belt 146 to the toner image producing stations.

In advance of the transfer nip, the transfer belt 146 passes an infra-red radiant heater 109 which raises the temperature of the toner particles to about 150° C., the optimum temperature for final transfer to the paper web 28. So as to ensure that the toner particles on the intermediate transfer belt 146 are not subjected to sudden cooling as they reach the guide roller 150, the latter is heated. By the use of an elevated temperature at the point of transfer to the paper web 28, and by virtue of the higher surface energy of the paper web relative to the intermediate transfer belt 146, the transfer of toner is 100% complete, so that there may be no necessity to clean excess toner particles from the intermediate transfer belt. Nevertheless, a cleaning device 58, such as a cleaning roller, may be provided to remove any residual toner particles from the transfer belt 146, which residual particles may result during start-up or run-down of the printer.

After leaving the heated guide roller 150 the temperature of the transfer belt 146 is reduced by a cooling device 110. This cooling device may, for example, be in the form of a bank of cold air spraying nozzles, directed at the adjacent surface of the transfer belt 146. In an alternative arrangement, the transfer belt 146 may pass through a chamber of significant size, containing cooled or even ambient air, where the temperature of the transfer belt 146 is allowed to fall. Such a chamber may include means for defining a festoon-like path for the transfer belt.

The printer shown in FIG. 10 is adapted for duplex printing. To achieve this, the printer further comprises a second transfer belt 148 which passes over major guide rollers 42, 44. A spring 45 acting on the major guide roller 44 is provided for tensioning the second transfer belt 148 whereby drive is transmitted from the major guide roller 42 to the transfer belt 148 to drive the transfer belt 148 in the direction shown by the arrow B past a second set of four toner image producing stations 46, 48, 50, 52. At the four toner image producing stations 46, 48, 50, 52, a plurality of toner images of different colors are transferred to the primary transfer belt in register with each other to form a second image.

After the transfer of the second multiple toner image thereto, the transfer belt 148 passes an infra-red radiant heater which raises the temperature of the toner particles, as described in connection with the first multiple image.

The first and second transfer belts 146, 148 are positioned in opposition to each other to form a transfer nip or contact region therebetween, through which the paper web passes. The transfer belts serve to feed the paper web through the printer. Thus the paper web 28 is brought into contact with the first and second transfer belts 146, 148 whereby the first multiple toner image is transferred to one face of the paper web while the second multiple toner image is transferred to the opposite face thereof.

Downstream of the transfer nip, the belt 146 passes the cleaning station 58 where residual toner is removed from the transfer belt and any residual electrostatic charge thereon is neutralized. Similarly, a second cleaning station 62 is provided for the second transfer belt 148.

As in the embodiment shown in FIG. 1, downstream of the drive roller pair 36, the paper web passes to a cutting station 66 where the web is cut into sheets which are collected in a stack 68. The web can be cut into sheets of variable length, depending on the length of the image transferred thereto. An infra-red radiant heater 70 for heating the paper web 28 is provided in advance of the transfer nip.

Figure 11:
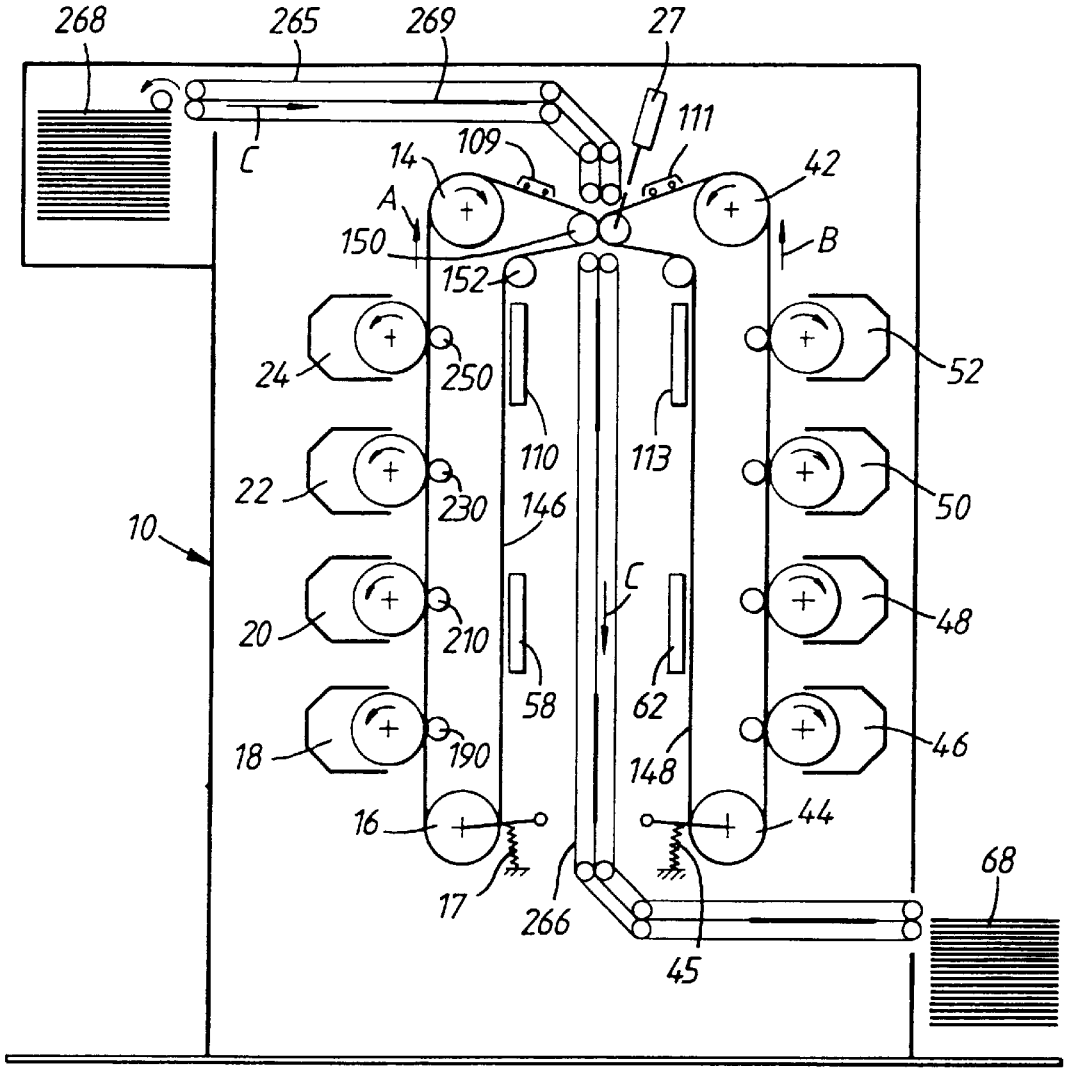
FIG. 11 illustrates a modification of the embodiment shown in FIG. 10, for cut sheet substrates instead of web substrates.

FIG. 11 shows an alternative embodiment whereby, instead of the substrate being in the form of a web, cut sheet feed is used. From a supply stack 268, sheets 269 are fed by means of a transport belt 265 towards the transfer nip in the direction of the arrow C. After transfer, the sheets 269 are further transported by means of a transport belt 266 towards the output stack 68.

Figure 12:
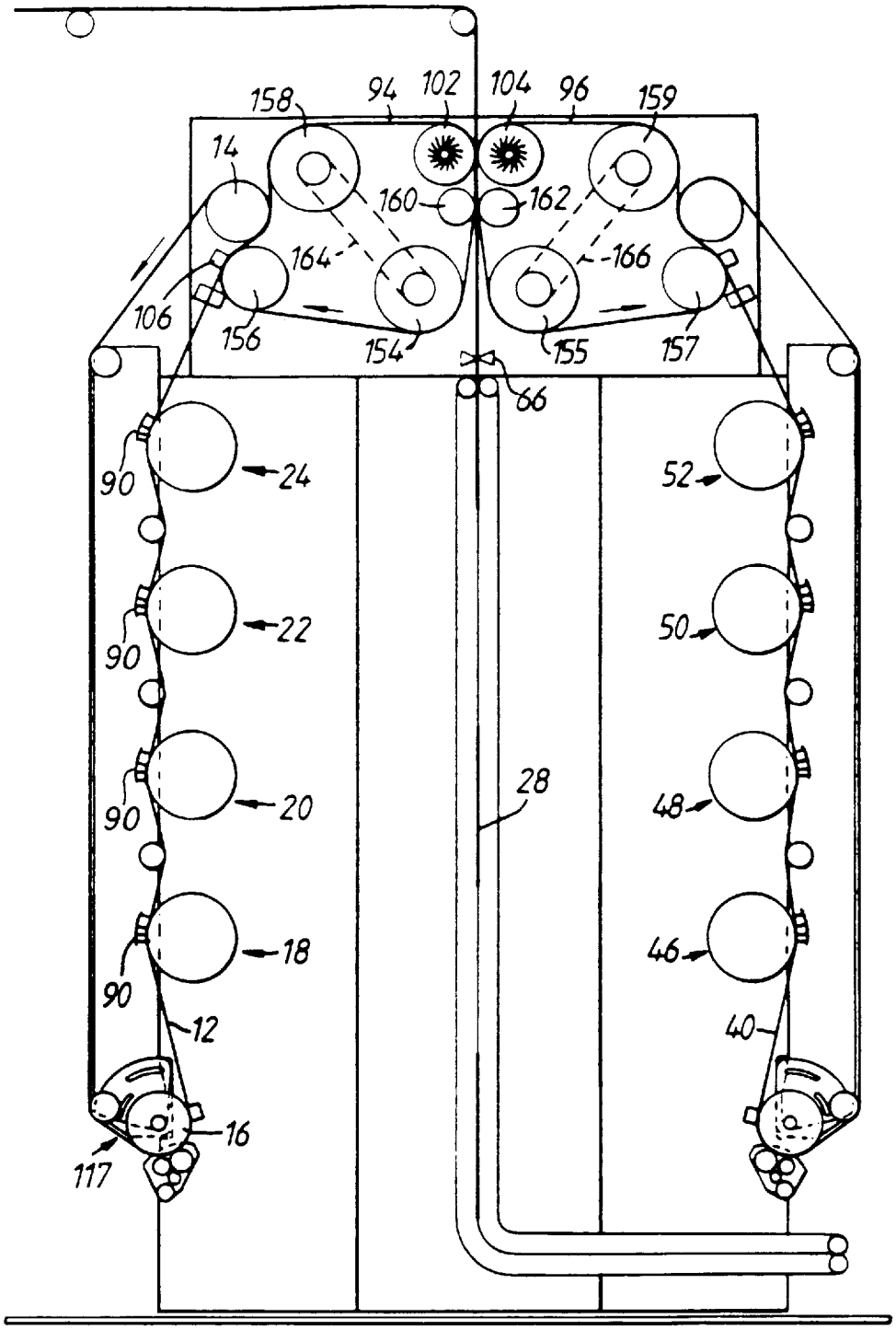
FIG. 12 illustrates a further alternative embodiment of a printer according to the invention.

The embodiment shown in FIG. 12 is similar to that shown in FIGS. 1 and 2. That is, FIG. 12 shows a single-pass, multi-color duplex electrostatographic printer which comprises a first primary seamless belt 12 which passes over major guide rollers 14, 16. The primary belt 12 moves past a set of four toner image producing stations 18, 20, 22, 24. At the four toner image producing stations 18, 20, 22, 24, a plurality of toner images of different colors are transferred by corona transfer devices 90 to the primary belt in register with each other to form a first multiple toner image.

A tensioning device 117 acts on the major guide roller 16 for tensioning the primary belt 12.

An intermediate transfer member in the form of a seamless transfer belt 94, is in contact with the primary belt 12 downstream of the last image producing station 24. In this embodiment, the intermediate transfer belt is in the form of a metal band of 70 $\mu$m thickness carrying a 25 $\mu$m thickness silicone coating. The transfer belt 94 passes over a pair of spaced guide rollers 156, 158 which are so positioned as to bring the transfer belt 94 into contact with the primary belt 12 as it passes over the upper guide roller 14. The guide roller 156 also acts as a cooling roller, being formed with a hollow interior through which cooling fluid, such as water, at a controlled temperature close to room temperature passes. The guide roller 158 also acts as a first stage heating roller, or pre-heating roller, being formed as a hollow roller through the hollow interior of which a heat transfer fluid such as water at an elevated temperature is passed. The transfer belt 94 also passes over guide rollers 102, 160 and 154. Drive is transmitted in turn from a drive motor (not shown) to the guide roller 102, via the transfer belt 94 to the primary belt 12 downstream of the toner image producing stations and to the toner image producing stations themselves.

The major guide roller 14 and the intermediate transfer belt 94 are positioned in opposition to each other to form a contact region therebetween, through which the primary belt 12 passes. Adherent contact between the primary belt and the intermediate transfer belt causes the primary belt and the intermediate transfer belt to move in synchronism with each other.

The multiple toner image adhering to the surface of the primary belt 12 is transferred to the moving intermediate transfer belt 94 by a transfer corona device 106.

The first stage heating roller 158 raises the temperature of the toner particles to about 90° C. The second stage heating roller 102 is heated, for example by use of an internal radiant heater.

After leaving the heated guide roller 102 the transfer belt 94 passes to a guide roller 160, the region between the guide rollers 102 and 160 constituting a contact region. After leaving the transfer region, the temperature of the intermediate transfer belt 94 is reduced by a first-stage cooling roller, or pre-cooling roller 154, which is in the form of a hollow roller through the hollow interior of which a cooling fluid such as water is passed. A heat transfer circuit 164 is provided, whereby heat extracted by the cooling fluid from the transfer belt 94 at the first stage cooling roller 154 is transferred to the first stage heating roller 158 to raise the temperature of the multi-color toner image on the transfer belt before transfer to the substrate. This arrangement reduces the energy requirement. The heat transfer fluid may be subjected to additional heating as, or before, it enters the hollow interior of the first stage heating roller 158 and/or may be subjected to further cooling as, or before it enters the hollow interior of the first stage cooling roller 154.

In a typical embodiment, the first-stage heating roller 158 raises the temperature of the multi-color toner image on the transfer belt 94 to about 90° C., the second-stage heating roller 102 raises the temperature further to about 160° C. ready, the optimum temperature for final transfer to the paper web 28. Following transfer of the image to the substrate, the first-stage cooling roller 154 reduces the temperature of the transfer belt 94 to about 90° C., while the cooling roller 156 reduces the temperature of the transfer member to about 20° C., which is well suited for electrostatic transfer of a further image onto the transfer belt 94.

The printer shown in FIG. 12 is adapted for duplex printing. To achieve this, the printer further comprises a second primary belt 40 which moves past a second set of four toner image producing stations 46, 48, 50, 52. At the four toner image producing stations 46, 48, 50, 52, a plurality of toner images of different colors are transferred to the primary belt in register with each other to form a second image.

A second intermediate transfer belt 96 is in contact with the second primary belt 40 downstream of the last image producing station 52 of the second set. The second intermediate transfer belt is guided over first-and second-stage cooling rollers 155, 157, a first-stage heating roller 159, the second-stage heating roller 104 and the guide roller 162.

The first heated guide roller 102, and the guide roller 160 are positioned in opposition to the second heated guide roller 104 and the guide roller 162, to form an extended transfer nip or contact region therebetween, through which the substrate in the form of a paper web passes. The intermediate transfer belts serve to feed the paper web 28 through the printer. Thus the paper web is brought into contact with the first and second intermediate transfer belts 94, 96 whereby the first multiple toner image is transferred to one face of the paper web while the second multiple toner image is transferred to the opposite face thereof. A cutting station 66 may be provided to cut the printed paper web into sheets.

After leaving the contact region, the temperature of the second intermediate transfer belt 96 is reduced by a first- and second-stage cooling rollers 155 and 157. A heat transfer circuit 166 is also provided as described hereinabove.

We claim:

1. A single-pass, multi-color electrostato-graphic printer comprising:

a transfer member;

drive means for moving the transfer member along a continuous path;

electrostatic deposition means for simultaneously depositing a plurality of toner images of different colors in powder form in register with each other on the transfer member to form a charged multiple toner image thereon; and substrate feed means for feeding substrate along a substrate path into contact with the transfer member, whereby the multiple toner image is transferred to at least one face of the substrate;

heating means for heating the multiple toner image on the transfer member in advance of the transfer of the multiple toner image to the substrate; and cooling means for cooling the transfer member following the transfer of the multiple toner image therefrom to the substrate to a temperature below the glass transition temperature $T_g$ of the toner, prior to the deposition of further toner images on the transfer member.

2. The printer according to claim 1, wherein the transfer member is an intermediate transfer member and the means for forming a multiple toner image on the transfer member comprises:

a primary transfer member;

means for guiding the primary transfer member past a set of toner image producing stations whereby a plurality of toner images of different colors are formed on the primary transfer member in register with each other to form the multiple toner image on the primary transfer member, the intermediate transfer member being in contact with the primary transfer member downstream of the image producing stations, whereby the multiple toner image is electrostatically transferred from the primary transfer member to be deposited on the intermediate transfer member.

3. The printer according to claim 1, wherein the substrate is in the form of cut sheets.

4. The printer according to claim 1, further comprising:

electrostatic deposition means for depositing a second such multiple toner image on a second transfer member, the substrate feed means being for feeding substrate along a substrate path into contact with the second transfer member, whereby the second multiple toner image is transferred to the opposite face of the substrate; and heating means for heating the second multiple toner image on the second transfer member in advance of the transfer of the second multiple toner image to the substrate; and cooling means for cooling the second transfer member following the transfer of the second multiple toner image therefrom to the substrate to a temperature below the glass transition temperature $T_g$ of the toner, prior to the deposition of further toner images on the second transfer member.

5. The printer according to claim 4, wherein the second transfer member is a second intermediate transfer member and the means for forming a second multiple toner image on the second transfer surface comprises:

a second primary transfer member;

means for guiding the second primary transfer member past a second set of toner image producing stations whereby a second plurality of toner images of different colors are transferred to the second primary transfer member in register with each other to form the second multiple toner image on the second primary transfer member, the second intermediate transfer member being in contact with the second primary transfer member downstream of the second set of image producing stations.

6. The printer according to claim 5, wherein the first and second intermediate transfer members are positioned in opposition to each other to form a nip therebetween, through which the substrate path passes.

7. The printer according to claim 1, wherein the heating means comprises a pre-heating roller and the cooling means comprises a pre-cooling roller, the pre-heating roller and the pre-cooling roller being in heat exchange relationship with each other.

8. A method of single-pass, multi-color electrostatographic printing comprising:

moving a transfer member along a continuous path;

simultaneously electrostatically depositing a plurality of toner images of different colors in powder form in register with each other onto the moving transfer member to form a charged multiple toner image thereon;

feeding substrate along a substrate path into contact with the moving transfer member, whereby the multiple toner image is transferred to at least one face of the substrate;

heating the multiple toner image on the moving transfer member in advance of the transfer of the multiple toner image to the substrate; and cooling the transfer member following the transfer of the multiple toner image therefrom to the substrate to a temperature below the glass transition temperature $T_g$ of the toner, prior to the deposition of further toner images on a second transfer member.

* * * * *